United States Patent [19]

Hayazaki

[11] 4,274,631

[45] Jun. 23, 1981

[54] BASEBALL PRACTICE BAT

[76] Inventor: Tadao Hayazaki, 497-1 Naoe Yourou-cho, Yourougun, Gifu-ken, Japan

[21] Appl. No.: 18,788

[22] Filed: Mar. 8, 1979

[30] Foreign Application Priority Data

Mar. 8, 1978 [JP] Japan ..... 53-030113

[51] Int. Cl.[3] ..... A63B 69/36

[52] U.S. Cl. ..... 273/26 B

[58] Field of Search ..... 273/26 B, 81 R, 81 D, 273/26 R, 183 R, 183 D, 186 A, 186 R, 194 R, 186 C, 81.2, 29 R, 193 R, 193 A

[56] References Cited

U.S. PATENT DOCUMENTS

| | | | |
|---|---|---|---|
| 3,113,782 | 12/1963 | Guier | 273/26 B |
| 3,116,926 | 1/1964 | Owen et al. | 273/26 B |
| 3,136,546 | 6/1964 | Connolly | 273/26 B |
| 3,572,706 | 3/1971 | Schroder | 273/26 B |
| 3,578,801 | 5/1971 | Piazza | 273/26 B |
| 3,897,058 | 7/1975 | Koch | 273/26 B |

*Primary Examiner*—Richard C. Pinkham
*Assistant Examiner*—T. Brown
*Attorney, Agent, or Firm*—Koda and Androlia

[57] ABSTRACT

A baseball practice bat to emit hitting sounds upon swinging is disclosed. The bat comprises a bat body with a hollow interior, a pipe fastened within the body with its top end fitting into a top cap and with its bottom end fitting into a grip, guide slits longitudinally formed in the pipe, a ring-shaped weight slidably mounted around the pipe, a supporting pin extending through the slits with its ends fixed to the weight, and an elastic member extending inside the pipe with its top end fixed to the weight at the pin.

4 Claims, 5 Drawing Figures

BASEBALL PRACTICE BAT

BACKGROUND OF THE INVENTION

1. Field of the Invention

This invention relates to a baseball practice bat and more particularly to a baseball practice bat designed to emit hitting sounds.

2. Prior Art

It has been very common for a baseball player to swing a bat for practice purposes. A variety of attempts have been made in connection with practice bats, such as giving heavier weight to a bat, a larger grip, an aluminum-made body and the like to obtain better efficiency in improving the player's skill. However, none of those attempts has given the players a feeling of real hitting. As a result, the player can not acquire top skill by merely swinging those practice bats; further, the players will soon lose interest in such rather monotonous exercise.

The practice bat of this invention is to give a solution to those problems that the prior art practice bat has failed to solve. The bat of this invention has such a structure that the players can enjoy hitting sounds when swinging said bat as they experience upon real hitting. Accordingly, the players can feel the hitting timing and improve their skill with utmost efficiency without losing interest.

SUMMARY OF THE INVENTION

It is the primary object of this invention to provide a baseball practice bat which is so designed to emit hitting sounds upon swinging the bat.

It is another object of this invention to provide a baseball practice bat which has means for adjusting the timing of the hitting sounds.

In keeping with the principles of this invention, the objects are accomplished by a unique structure for a baseball practice bat comprising a body made of light metal with a hollow interior, a pipe fastened within the interior of said body with its top end fitting into a top cap and with its bottom end fitting into a grip, guide slits longitudinally formed in the pipe, a ring-shaped weight slidably mounted around the pipe, a supporting pin extending through the slits with its ends fixed to the weight, and an elastic member extending inside the pipe with its top end fixed to the weight at the pin.

BRIEF DESCRIPTION OF THE DRAWINGS

The above-mentioned features and objects of the present invention will become more apparent with reference to the following description taken in conjunction with the accompanying drawings, wherein like reference numerals denote like elements, and in which.

DETAILED DESCRIPTION OF THE INVENTION

Figures 1, 2, 3, 4, 5:
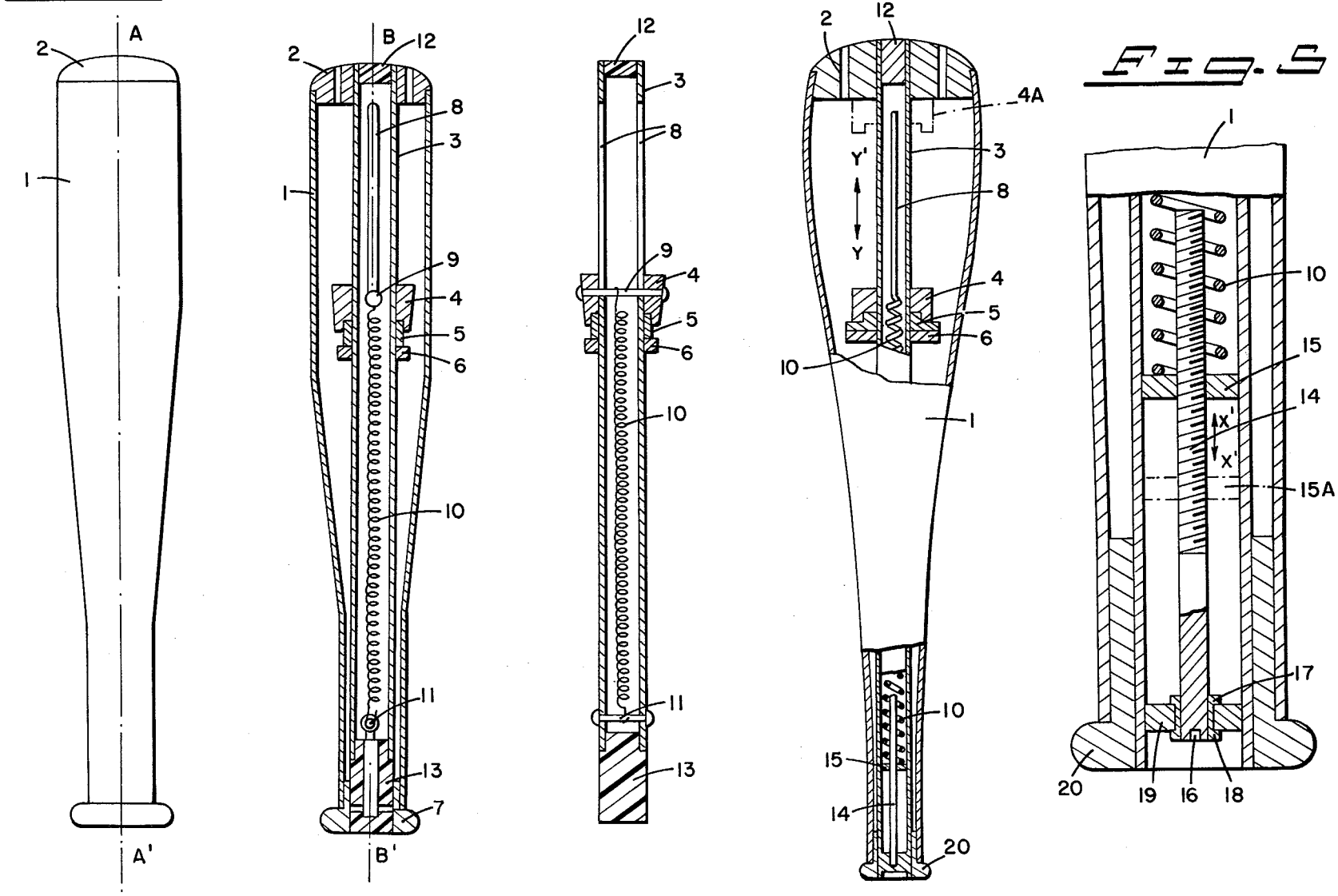
FIG. 1 shows a plan view of an embodiment of the bat of this invention.
FIG. 2 shows a cross-sectional view of the bat in FIG. 1 taken along the line A—A'.
FIG. 3 shows a cross-sectional view of a part of the bat in FIG. 2 taken along the line B—B'.
FIG. 4 shows a cross-sectional view of another embodiment of the bat of this invention.
FIG. 5 shows a cross-sectional view of a part of the bat in FIG. 4.

Referring to FIG. 1 through 3 showing a first embodiment of this invention, where like reference numerals denote like elements, a bat body 1 is made of aluminum with a hollow interior. In the body 1, a round pipe 3 is disposed with its top end 12 fitting into a top cap 2 and with its bottom end fitting into a grip 7. The pipe 3 has a pair of guide slits 8 longitudinally formed in the opposite side thereof and a pin 9 extends through the slits 8 of the pin 9.

The pin 9 is fastened to a ring-shaped weight 4 slidably mounted around the pipe 3. The pipe 9 is further connected with a spring coil 10. The spring coil 10 extends inside the pipe 3 and its end is fastened to a fixed pin 11 at the bottom portion of the pipe 3. Thereby, the weight 4 moves toward the top cap 2 along the pipe 3 upon swinging the bat body 1 by centrifugal force and strike the top cap 2 creating hitting sounds. After striking the top cap 2, the weight 4 gets back by the pulling force of the spring coil 10 to a stopper 5 made of rubber which is further supported by a supporter 6. Thus, the weight 4 creates hitting sounds only when it strikes the top cap 2 but not when it hits the rubber stopper 5 whose elasticity is to absorb the impacts caused by the weight 4.

The top cap 2 is provided with a number of apertures 20 therein so that the hitting sounds created by the weight 4 can escape outward.

In order to get the best results, the bat may be so adjusted that the bat creats hitting sounds at the same timing as in real hitting. This can be done by adjusting the weight 4, the length of the slits 8 and the strength of the coil spring 10.

Now referring to FIGS. 4 and 5, there is shown another embodiment of this invention. The bat of this embodiment is equipped with means for adjusting the hitting timing.

The bat of this embodiment has most of the basic elements of the first embodiment; namely a body 1 made of light metal with a hollow interior, a pipe 3 fastened within the body 1 with its top end fitting into a top cap 2 and with its bottom end fitting into a grip 7, guide slits 8 longitudinally formed in the pipe 3, a ring-shaped weight slidably mounted around the pipe 3, a supporting pin 9 extending through the slits 8 with its ends fixed to the weight 4, and a spring coil 10 extending inside the pipe 3 with its top end fixed to the weight at the pin 9. The bat further comprises a regulating shaft 14 with threads inside the pipe 3 with its bottom end clamped into a fixed cap 18 supported by a fastener 19, a groove 16 provided on the bottom surface of the shaft 14 and a nut 15 movably fitted around the shaft 14 upon rotating the shaft 14, said nut 15 is connected to the bottom end of the spring coil 10. Thereby, upon rotating the shaft 14 by a screw driver to be inserted into the groove 16, the nut 15 moves either upward or downward at player's discretion causing the spring coil 10 to get either looser or tighter. Thus, the hitting timing can be adjusted by simply screwing the shaft 14. As particularly shown in FIG. 5, the nut 15 will move from its original position X' to new position X, whereby the spring coil 10 gets looser correspondingly.

By thus adjusting the spring coil 10, the weight 4 will move upward from its original position Y to hitting position Y' to strike the top cap 2 and create hitting sounds at a right timing and move back to the stopper 5.

I claim:

1. A baseball practice bat comprising a body with a hollow interior, a pipe fastened within the body with one of its ends fitting into a cap at one end of said bat and its other end fitting into the handle at the other end of said bat, a pair of diametrically opposed, guide slits longitudinally formed in said pipe, a weight slidably mounted exteriorly around said pipe, a supporting pin extending through said guide slits and said weight and slidably fixing said weight to said pipe, and an elongated elastic member extending inside the pipe having one of its ends fixed to the weight at the pin and its other end fixed at the handle of the bat.

2. A baseball bat according to claim 1, wherein said body is made of aluminum.

3. A baseball bat according to claim 1, wherein said elastic member is a spring coil.

4. A baseball bat according to claim 3, wherein said spring coil is connected to a nut movably disposed around an elongated member, said elongated member extending from said grip into said spring coil, said stick having a groove on the bottom surface thereof, whereby said stick can be rotated to cause the nut to move for adjusting said spring coil.

* * * * *